United States Patent [19]

Quay

[11] 4,408,370

[45] Oct. 11, 1983

[54] SHORT FIBER FEED SYSTEM FOR SLIVER HIGH PILE FABRIC KNITTING MACHINES

[75] Inventor: Earl R. Quay, Orangeburg, S.C.

[73] Assignee: Mayer, Rothkopf Industries, Inc., Orangeburg, S.C.

[21] Appl. No.: 380,532

[22] Filed: May 21, 1982

Related U.S. Application Data

[63] Continuation-in-part of Ser. No. 338,251, Jan. 15, 1982, abandoned, which is a continuation-in-part of Ser. No. 295,731, Aug. 24, 1981.

[51] Int. Cl.[3] ..... D01G 15/40; D01G 15/84; D04B 9/12

[52] U.S. Cl. ..... 19/105; 19/114; 66/9 B

[58] Field of Search ..... 66/9 R, 9 B; 19/105, 19/106 R, 114

[56] References Cited

U.S. PATENT DOCUMENTS

| | | | |
|---|---|---|---|
| 906,993 | 12/1908 | Bates et al. | 19/114 |
| 1,114,414 | 10/1914 | Tauber | 226/87 |
| 2,735,140 | 2/1956 | Fournier | 19/114 |
| 3,010,297 | 11/1961 | Hill | 66/9 B |
| 3,058,168 | 10/1962 | LaRoche | 19/114 |
| 3,290,729 | 12/1966 | Maynard | 19/114 |
| 3,299,672 | 1/1967 | Schmidt | 19/105 X |
| 3,427,829 | 2/1969 | Wiesinger | 66/9 B |
| 3,685,315 | 8/1972 | Delberghe | 66/9 B |
| 3,896,637 | 7/1975 | Thore | 66/9 B |
| 3,968,662 | 7/1976 | Kunak et al. | 66/9 B |
| 4,222,154 | 9/1980 | Stäheli et al. | 19/105 |
| 4,258,557 | 3/1981 | Kunde | 66/9 B |

FOREIGN PATENT DOCUMENTS 299 of 1874 United Kingdom ..... 19/105

*Primary Examiner*—Louis Rimrodt

*Attorney, Agent, or Firm*—Harding, Earley, Follmer & Frailey

[57] ABSTRACT

A fiber feeding system for feeding relatively short sliver fibers—less than one inch in length—to a sliver high pile fabric knitting machine. The system includes the usual basic elements of a carding head comprising the sliver feeding components, such as a pair of rotatable sliver feed rolls, a rotatable wire-covered doffer and a rotatable wire-covered main cylinder interposed between the sliver feeding components and the doffer. By utilizing a sliver feed plate as one of the sliver feeding components, together with one or more sliver feed rolls, the fiber pinch point may be advanced close to the periphery of the main cylinder. Where one or more pairs of sliver feed rolls are utilized without a sliver feed plate, each roll has a circumference not exceeding four times the minimum length of the sliver fibers. The peripheries of the main cylinder and doffer are provided with wire coverings whereof the individual wires have novel configurations designed to prevent excessive fiber build up, while permitting the fibers to be transferred by the main cylinder to the doffer in sheet form having a relatively thick and relatively narrow cross-sectional configuration. The invention contemplates the elimination of the main cylinder, whereby the sliver feeding components may feed sliver directly to the doffer.

11 Claims, 6 Drawing Figures

SHORT FIBER FEED SYSTEM FOR SLIVER HIGH PILE FABRIC KNITTING MACHINES

RELATED APPLICATIONS

This patent application is a continuation-in-part of my pending U.S. patent application Ser. No. 338,251 filed Jan. 15, 1982 entitled "Short Fiber Feed System for Sliver High Pile Fabric Knitting Machines", now abandoned, which, in turn, is a continuation-in-part of my pending U.S. patent application Ser. No. 295,731 filed Aug. 24, 1981 entitled "Self-Cleaning Doffer Wire".

FIELD OF THE INVENTION

The invention concerns knitting of sliver high pile fabrics on circular knitting machines such as are illustrated in Tauber U.S. Pat. No. 1,114,414, Hill U.S. Pat. No. 3,010,297, Schmidt U.S. Pat. No. 3,299,672, Wiesinger U.S. Pat. No. 3,427,829 and Thore U.S. Pat. No. 3,896,637. High pile fabric knitting machines generally are rotary machines provided with a plurality of carding heads, constituting fiber carding and feeding units, for supplying carded sliver fibers to the knitting needles. Usually, the needles are mounted independently in a cylinder which is rotatable relative to carding heads disposed at circumferentially spaced locations around the cylinder.

DESCRIPTION OF THE PRIOR ART

The carding heads for feeding carded sliver fibers to the needles of high pile fabric knitting machines are constituted of at least one pair of rotatable sliver feed rolls—usually having either wire-covered or fluted peripheries—a rotatable wire-covered main cylinder and a rotatable wire-covered doffer. The sliver feed rolls draw sliver in rope form from a source of supply, and deliver the fibers, in sheet form, to the main cylinder. The latter, acting as a transfer medium, conveys the sheet of sliver fibers to the doffer which, in turn, feeds the fibers to the needles of the knitting machine. In order to properly transfer the fibers during their delivery to the needles, the main cylinder is caused to rotate faster than the sliver feed rolls, and the doffer is caused to rotate faster than the main cylinder.

Carding heads heretofore utilized in the sliver high pile fabric knitting industry have suffered from two serious disabilities. First, they have not been capable of handling sliver fibers of relatively short length—i.e., less than one inch, due to structural limitations and the wire configurations heretofore utilized. Second, the wire-covered peripheries of the main cylinders and doffers heretofore utilized have been susceptible to undesirable fiber build up, which leads to serious fabric quality problems and excessive down time of the knitting machines. Fiber build up on doffers has been particularly serious, because it frequently causes needle breakage and lack of uniformity in the density of the pile of the fabric being knitted. When such problems develop, the knitting machine must be shut down while remedial measures are undertaken.

SUMMARY OF THE INVENTION

The primary object of this invention is to provide a new and improved fiber feeding system for sliver high pile fabric knitting machines which permits the feeding of relatively short sliver fibers—less than one inch in length—to the needles of the knitting machine.

A further object of this invention is to provide a new and improved sliver feeding system for sliver high pile fabric knitting machines which reduces substantially the problem of excessive fiber build up on the wire peripheries of the main cylinder and the doffer.

A further object is to provide novel, small diameter, sliver feed rolls for such a feeding system having a nip or fiber pinch point located relatively close to the wire periphery of the main cylinder, thereby permitting feeding of short fibers to a sliver high pile fabric knitting machine.

A further object is to provide improved fillet wire for the main cylinder of a carding head which permits sliver fibers to be impaled on the wire periphery of the said cylinder in the form of a sheet of fibers which is substantially thicker and narrower than heretofore achieved, and which permits the fibers to be readily transferred to the doffer without excessive fiber build up on the main cylinder.

A further object is to provide sliver feeding components, including a sliver feed plate, to provide a sliver pinch point relatively close to the wire periphery of the main cylinder.

A further object is to provide improved fillet wire for the doffer which enables the needles of the knitting machine to easily and efficiently rake all, or substantially all, of the fibers from the wire periphery of the doffer, thereby avoiding excessive and undesirable fiber build up on the doffer.

Other objects and advantages of this invention will be readily apparent from the accompanying detailed description of the preferred embodiments thereof, which are illustrated in the views of the accompanying drawing.

DESCRIPTION OF THE INVENTION

Figure 1:
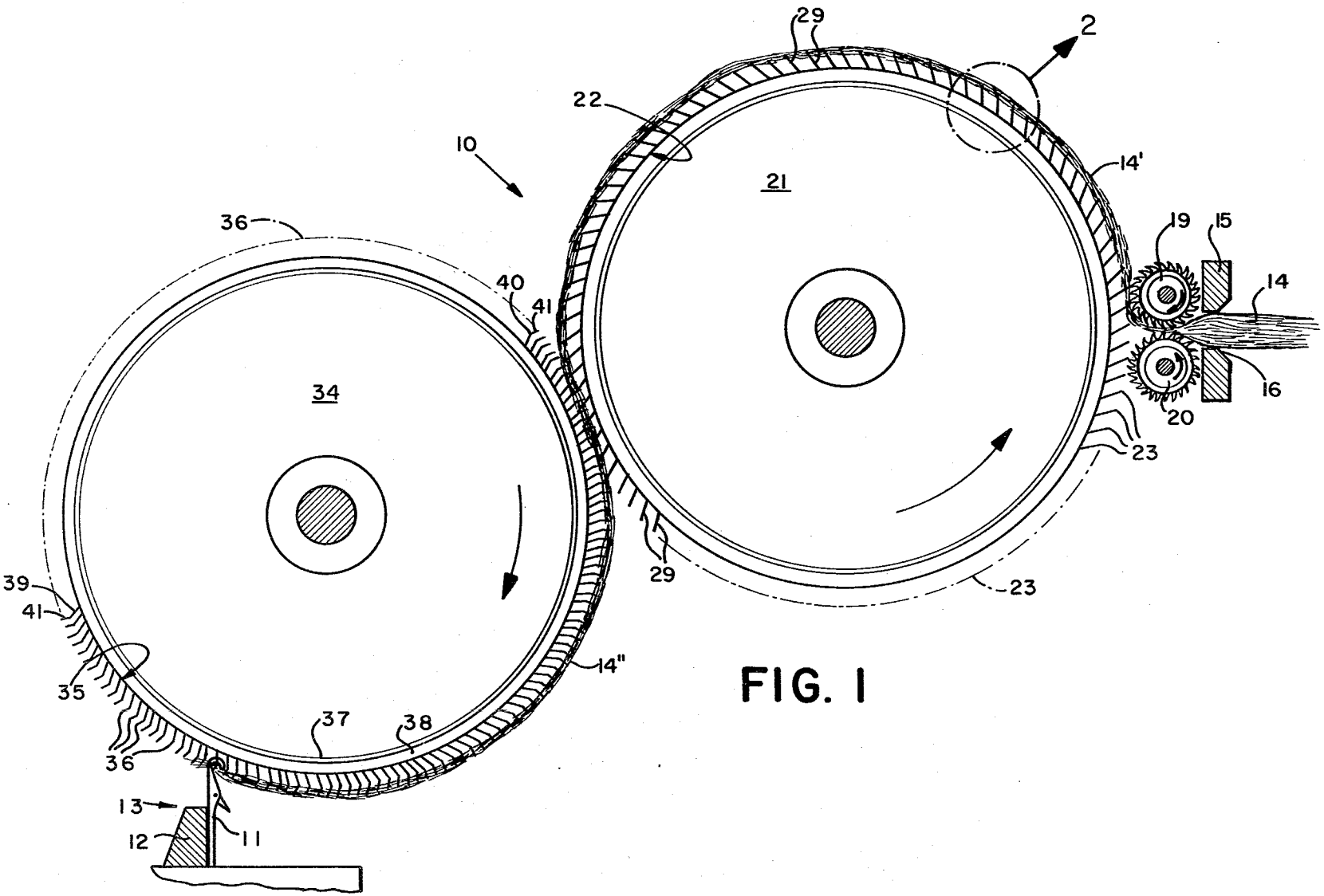
FIG. 1 is a fragmentary, schematic view in vertical section of a pile fiber carding and feeding unit incorporating a preferred embodiment of this invention, showing portions of a sliver high pile fabric circular knitting machine.
Figure 2:
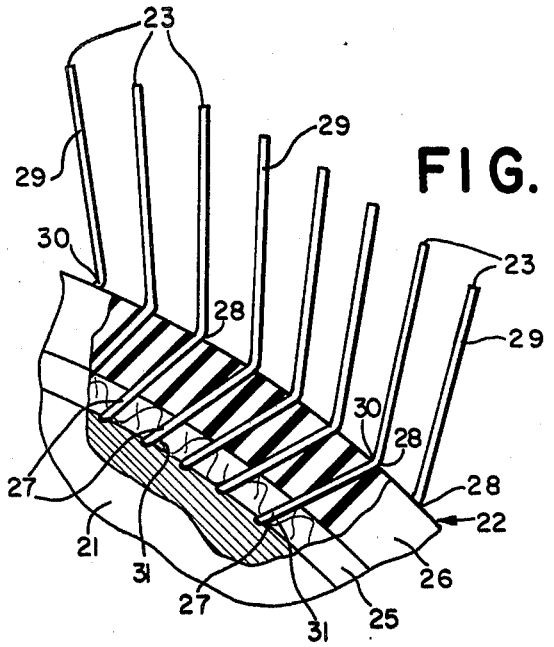
FIG. 2 illustrates in partial vertical section an enlarged, fragmentary view of the periphery of the main cylinder of the unit of FIG. 1, taken from within the broken circle indicated at 2 in FIG. 1.

Referring first to FIGS. 1 and 2 of the drawing, where a preferred embodiment of this invention is disclosed, there is illustrated schematically a fiber carding and feeding unit 10, often referred to as a "carding head", constituted basically of the usual vertically aligned rotatable sliver feed rolls or components 19, 20, a wire-covered rotatable main cylinder 21 and a wire-covered rotatable doffer 34. The carding head 10 feeds the fiber 14', 14'', constituting the fibers of a sliver or roving 14, from a source of supply (not shown) to the vertical needles 11 mounted for independent reciprocatory movement in the rotatable needle cylinder 12 of a conventional sliver high pile fabric circular knitting machine 13.

The sliver feed rolls 19, 20 pull the sliver 14 through the horizontally elongated slot 16 of the usual sliver guide plate 15 for delivery to the fillet wires 23 of the main cylinder 21. In the embodiment shown in FIG. 1, both of the sliver feed rolls 19, 20 are provided circumferentially with spirally wound, sawtooth-configured wire clothing. The distal ends of the wires of the two rolls 19, 20 constitute the peripheries thereof, and provide at their area of contact a nip or pinch point to compress the sliver fibers as they are fed by the feed rolls to the wire-covered main cylinder 21. Since the main cylinder rotates faster than the feed rolls 19, 20, it tends to pull the sliver fibers from the feed rolls. The nip or pinch point of the feed rolls 19, 20 serves to obstruct and retard the advance of the fibers to the main cylinder 21, thereby enhancing the "combing" effect on the fibers, i.e. their conversion from a roving 14 in "rope" form to a relatively flat sheet of axially aligned fibers 14' disposed on the wire-covered periphery of the main cylinder 21.

The diameters of the fiber feed rolls 19, 20 are very small, compared to the diameters of conventional sliver feed rolls, thereby permitting the feeding of sliver fibers or staple of relatively short length—less than one inch—to the main cylinder 21. It is essential that the fibers 14' be tensioned throughout their delivery from the feed rolls 19, 20 to the fillet wires 23 of the main cylinder 21. To ensure that such fiber tension is maintained at all times, the distance from the pinch point or nip of the feed rolls 19, 20 to the distal ends of the wires 23 of the main cylinder must be less than the minimum length of the fibers constituting the sliver 14. Thus, each of the feed rolls 19, 20 has a circumference, defined by the distal ends of their wires, which is no larger than four times the minimum length of the fibers 14', 14'' constituting the sliver 14. By way of example, where the minimum length of the fibers is 0.6 inch, the diameter of the feed rolls 19, 20, measured to the distal ends of their wire peripheries, should be no larger than 0.75 inch.

In practice, a slight clearance is maintained between the wire periphery of the upper sliver feed roll 19 and the wire periphery of the main cylinder 21. Preferably, such clearance should not exceed 0.008 inch.

Referring specifically to FIG. 2, it will be observed that the main cylinder 21 is enveloped by card clothing 22 comprised of an inner backing layer 25 preferably composed of woven cotton fabric, an outer backing layer 26 preferably composed of foam rubber and the plural outwardly extending fillet wires 23, the distal ends of which constitute the wire periphery of the main cylinder. The card clothing 22 is secured to the surface of the main cylinder 21 by means of a suitable adhesive or binder (not shown).

The wires of the main cylinder 21 are constituted of inner or shank portions 27, which are embedded in the backing layers 25, 26 in cantilever fashion, and outer or distal portions 29. The shank portions 27 of the wires 23 are connected to the distal portions 29 by means of bends or knee portions 28 located at the outer surface of the rubber layer 26. The knee portions 28 of the wires 23 are bent to form an angle in excess of 90°, preferably on the order of about 135°. The knee angles 30, defined by the junction of the distal portions 29 of the wires 23 and the periphery of the outer backing layer 26, preferably are on the order of 60°. The acute shank angles 31, defined by the proximal ends of the shank portions 27 of the wires 23 and the peripheral surface of the inner backing layer 25, preferably are on the order of 70°. By the arrangement thus described, the distal portions 29 of the wires 23 extend linearly outward of the main cylinder 21 at an acute angle 30 relative to the outer surface of the rubber layer 26 on the order of 60°.

Referring back to FIG. 1, it will be observed that the main cylinder 21 performs its usual function of a transfer medium for conveying the sliver fibers 14' from the wire-covered feed rolls 19, 20 to the distal ends of the fillet wires 36 of the doffer 34. To facilitate the transfer of the fibers 14' to the doffer, the distal portions 29 of the main cylinder wires 23 mesh with the distal portions 41 of the doffer wires 36.

The novel configuration of the main cylinder wires 23, constituting straight or linear distal portions 29 extending angularly outward relative to the periphery of the outer backing layer 26, facilitates penetration of the fibers 14' inward of the peripheral wire surface of the main cylinder 21, in the direction of the surface of the layer 26, during delivery of the fibers 14' from the sliver feed rolls 19, 20 to the doffer 34. To further facilitate migration of the sliver fibers 14' toward the rubber surface of the outer backing layer 26, the density of the fillet wires 23 extending from the periphery of the main cylinder 21 is reduced from 11 noggs per inch—which is the conventional distribution—preferably to a density on the order of 6 noggs per inch. This approximately 45% reduction in nogg density of the main cylinder wires 23, combined with their novel configuration, enables substantially increased fiber absorption inwardly from the distal ends of the wires 23 toward the surface of the backing layer 26. The result is to permit the fibers 14' to be transferred by the main cylinder 21 to the doffer 34 in a sheet of fibers which is much thicker than that realized in previous sliver knitting practice while, at the same time, substantially reducing the width of the sheet of fibers 14' as it passes to the doffer 34.

The fillet wires 36 of the doffer 34 are of the self-cleaning type disclosed in my pending U.S. patent application Ser. No. 295,731, aforesaid. More specifically, as explained in that application, the doffer 34 is enveloped by card clothing 35 which is affixed to the periphery of the doffer 34 by a suitable adhesive or binder (not shown). The card clothing 35 of doffer 34 is comprised of an inner backing layer 37 of woven cotton, an outer backing layer 38 of foam rubber and the plural, peripherally distributed fillet wires 36.

The doffer wires 36 are constituted of outer or distal wire portions 41, intermediate knee portions 40 and inner or shank portions 39, the latter having the major portion of their length embedded in cantilever fashion in the backing layers 37, 38. As explained in patent application Ser. No. 295,731 aforesaid, the knee portions 40 of the wires 36, connecting the shank portions 39 to the distal portions 41 thereof, preferably are formed with an angle on the order of 155°. However, the invention can be practiced with considerable success where the angles of the doffer wire knees 40 fall within the range of 145° to 170°. The angle of the doffer wire knees 41 should not be permitted to be less than 130° in the practice of the invention, nor greater than 170°.

By forming the doffer wires 36 in the manner described, with the angles of the knee portions 40 preferably falling within the range of 145° to 170°, the sliver fibers 14'' transferred to the wire periphery of the doffer 34 by the main cylinder 21 will tend to migrate toward the distal ends of the doffer wires 36. This tendency of outward migration by the fibers 14'', as they are delivered to the knitting machine needles 11, eliminates undesirable fiber build up on the exposed portions of the shanks 39 of the doffer wires 36, while providing for the quick and easy release of the fibers to the hooks of the knitting needles 11.

By this invention, not only are slivers constituted of relatively short fibers or staple—less than one inch in length—capable of being delivered efficiently and rapidly to the knitting machine needles 11 for incorporation into knitted sliver high pile fabric, but excessive fiber build up on the wire periphery of the doffer 34, resulting from reduced surface speed of the doffer, which long has plagued the efforts to reduce fiber loss in sliver high pile fabric knitting, for all practical purposes is eliminated. Thus, the sliver feeding system of this invention also provides a novel and desirable "self-cleaning" effect not heretofore achieved in this art.

Figure 3:
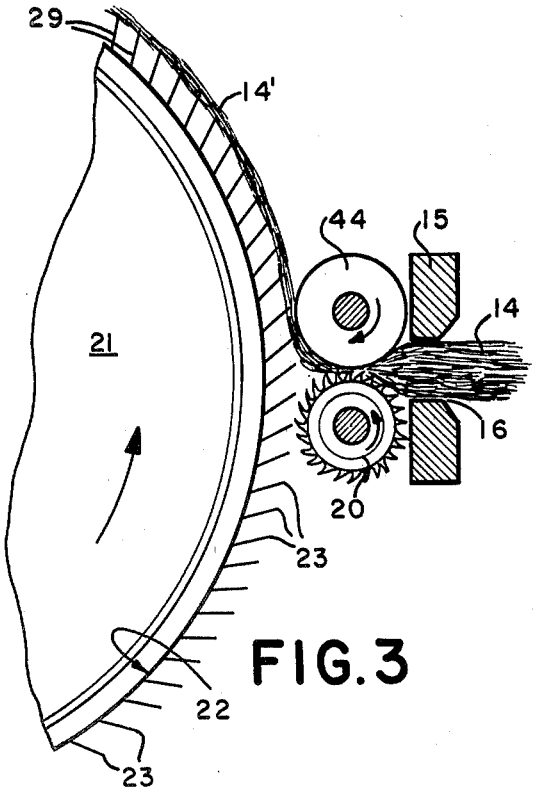
FIG. 3 is an enlarged, fragmentary view in vertical section illustrating a first modification of the invention.

In the modification of the invention illustrated in FIG. 3, the upper wire-covered sliver feed roll 19 has been replaced by a small diameter feed roll 44 having a smooth, hard, preferably metallic periphery, such as steel. This modified arrangment not only avoids fiber penetration relative to the surface of the upper sliver feed roll, but it minimizes the extent to which the upper roll 44 retains and retards the sliver fibers as they are delivered to the main cylinder 21. As a result of the arrangement illustrated in FIG. 3, the fibers of the sliver 14 are positioned more outwardly of the peripheries of the sliver feed rolls, thereby positioning those fibers closer to the distal ends of the wires 23 of the main cylinder 21 as they are fed thereto.

Figure 4:
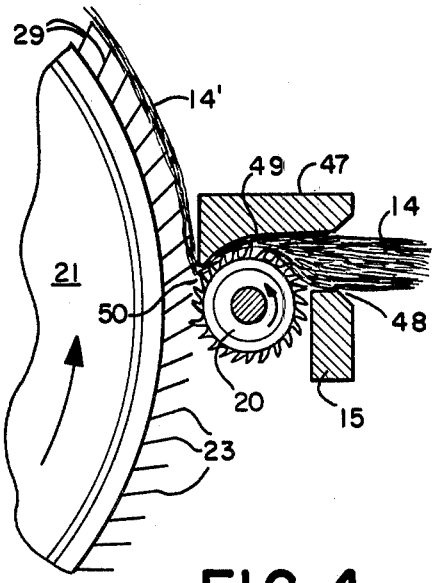
FIG. 4 is an enlarged, fragmentary view in vertical section illustrating a second modification of the invention.

In the modification of FIG. 4, a sliver feed plate 47 may be used in place of the upper rotatable sliver feed rolls 19 or 44. Upper sliver feed plate 47 may be formed integral with, or may be separate from the lower sliver guide plate 15. In either event, disposed between the plates 47, 15 is the usual horizontally elongated slot 48 through which the sliver 14 is drawn by the lower rotatable sliver feed roll 20. The upper sliver feed plate 47 extends radially inward relative to the main cylinder 21, and terminates close to the distal ends of the main cylinder wires 23, preferably providing a clearance not in excess of 0.008 inch. The lower inner surface of the sliver feed plate 47 is curved downwardly, about and relative to the wire periphery of the lower feed roll 20, to provide a gap or fiber passage 49 progressively reducing in thickness and which terminates in a nip or filter pinch point 50 in close proximity to the distal ends of the main cylinder wires 23. The arrangement of FIG. 4—locating the nip or pinch point 50 of the sliver feeding means or components 20, 47 of the invention in close proximity to the wire periphery of the main cylinder 21—results in a substantial reduction in the distance between the fiber pinch point 50 and the main cylinder wires 23. The result of the arrangement is to permit the feeding of very short sliver fibers—on the order of about 0.5 inch in length—through the novel short fiber sliver feeding system of this invention to the needles 11 of the knitting machine 13.

Figure 5:
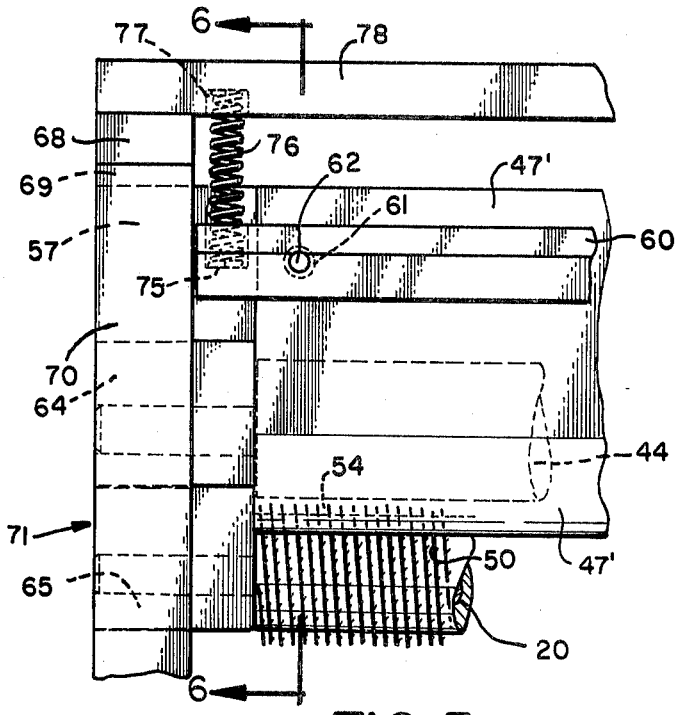
FIG. 5 is an enlarged, fragmentary view in vertical elevation illustrating a third modification of the invention.
Figure 6:
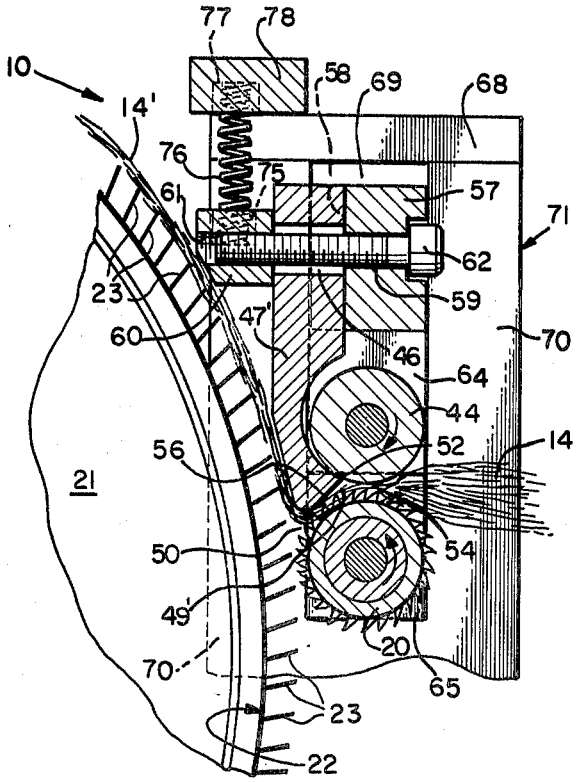
FIG. 6 is a fragmentary view in section taken as indicated by the angled arrows 6—6 of FIG. 5, and showing a portion of the main cylinder.

FIGS. 5 and 6 illustrate an extremely useful modification of this invention in which the components for feeding sliver 14 to the main cylinder 21 constitute the lower wire-covered sliver feed roll 20, the upper smooth-peripheried sliver feed roll 44 and a modified sliver feed plate 47'. The sliver feeding components 20, 44, 47' are supported by the usual transversely disposed U-shaped feed stand 71, of which one upright or vertical leg portion 70 is partially illustrated in FIGS. 5 and 6. Formed in the upright 70 of feed stand 71 is a vertical, elongated slot 69, the upper end of which is closed by a cap or plate 68 secured to the top of the upright 70 by any suitable means such as spaced bolts (not shown). The other vertical upright (not shown) of the U-shaped feed stand 71 is of the same construction as upright 70, and has formed therein a vertical, elongated slot at the same relative location and of the same configuration as slot 69.

In accordance with conventional practice, the U-shaped feed stand 71 supports, between its two transversely spaced uprights 70, the rotatable sliver feed rolls 20, 44. The transversely extending shafts of the rolls 20, 44 are supported rotatably by plastic bearing blocks disposed in the transversely spaced vertical slots formed in the uprights of the feed stand 71. In FIG. 6, there are illustrated vertically aligned, contiguous bearing blocks 64, 65 mounted in the lower portion of slot 69 of upright 70. Upper bearing block 64 supports rotatably one end of the shaft of the upper roll 44, and lower bearing block 65 supports rotatably one end of the shaft of the lower roll 20. It will be understood that a similar bearing and shaft support arrangement is provided for the rotatable support of the opposite ends of the sliver feed rolls 20, 44.

Sliver feed rolls 20, 44 are selectively disposed vertically relative to each other to provide a nip 54 which, in the preferred practice of this embodiment, varies in clearance between a minimum of 0.5 mm and a maximum of 2.0 mm. The preferred minimum clearance of 0.5 mm for the nip 54 is established by the design and disposition of the vertical bearing blocks 64, 65.

The sliver feed plate 47', like the sliver feed rolls 20, 44, extends transversely across the space between the two vertical uprights of the U-shaped feed stand 71 (FIG. 5). As best shown in FIG. 6, sliver feed plate 47' is provided with a lower depending portion which terminates within the transverse space defined roughly or generally by the adjacent peripheries of the feed rolls 20, 44 and the main cylinder 21. The lowermost portion of the sliver feed plate 47' is of generally wedge or V-shaped cross-sectional configuration, the two outer, downwardly converging surfaces of which are disposed, respectively, in close proximity to the wire-covered periphery of the main cylinder 21 and the wire-covered periphery of the lower sliver feed roll 20.

As will be observed, the lower inclined surface 56 of the sliver feed plate 47' and the periphery of the lower sliver feed roll 20 converge to form a fiber pinch point 50 which is disposed in close proximity to the distal ends of the main cylinder wires 23. Like nip 54, the fiber pinch point 50 provided by the sliver feeding components 20, 47' preferably has a minimum clearance on the order of 0.5 mm. As in the embodiment of FIG. 4, the location of the fiber pinch point 50 in close proximity to the wire periphery of the main cylinder 21 permits the feeding of very short sliver fibers 14', 14'' by the carding head 10 to the needles 11 (FIG. 1) of the knitting machine 13.

THe lower depending portion of the sliver feed plate 47' is provided with a transversely extending edge 52 which, in the manner of a doctor blade, is disposed lightly in contact with the peripheral surface of roll 44. The transverse space surrounded by pinch point 50, surface 56 and edge 52 of the feed plate 47', nip 54 and the peripheries of the rotatable sliver feed rolls 20, 44 constitutes the fiber passage 49' through which the fibers of sliver 14 pass en route to the main cylinder 21. The light, contiguous relationship between the sliver feed roll 44 and the edge 52 of the sliver feed plate 47' ensures the smooth flow of sliver fibers through the passage 49', thereby avoiding an accumulation of fibers with consequent wrapping of fibers about the roll 44.

The upper portion of the sliver feed plate 47' is clamped in operative position between a notched, transversely extending support plate 57 and a second, transversely extending support plate 60, the two plates 57, 60 being disposed in spaced, parallel relation to each other.

As will be observed from FIG. 6, the upper portion of the sliver feed plate 47' engages within a transversely extending notch 58 formed in the first support plate 57. The second support plate 60 is provided with a pair of transversely spaced threaded holes 61, of which only one is shown in FIGS. 5 and 6. Threadingly engaged within the threaded holes 61 is a pair of transversely spaced threaded bolts 62, of which only one is illustrated. Each bolt 62 passes through a counter-bored clearance hole 59 in the first support plate 57 and through clearance hole 46 in the sliver feed plate 47' to engage threadingly within one of the holes 61 in the second support plate 60. Tightening of the bolts 62 draws the ensemble comprising the support plates 57, 60 and the sliver feed plate 47' firmly together, to clamp plate 47' in operative position relative to the sliver feed rolls 20, 44 and the main cylinder 21, as best illustrated in FIG. 6. As the bolts 62 are tightened, sliver feed plate 47' is adjusted manually so that its transverse edge 52 is operatively located in light contact with the smooth periphery of sliver feed roll 44.

Support plate 57 rests on the upper surfaces of the upper bearing blocks 64, and extends transversely across the gap between the spaced uprights 70 of the U-shaped feed stand 71. By the foregoing arrangement, in which sliver feed plates 47' is clamped between spaced supports 57, 60 by the bolts 62, with that ensemble resting on the transversely spaced, upper bearing blocks 64, the upper sliver feed roll 44 and the sliver feed plate 47' are assembled as a unit, with capacity to move up and down vertically in unison relative to the lower sliver feed roll 20.

Formed in the top of the second support plate 60 are a pair of transversely spaced, vertical recesses 75, only one of which is illustrated in FIGS. 5 and 6. Disposed in each of the spaced recesses 75 is a vertical compression spring 76, of which only one is illustrated in FIGS. 5 and 6. The lower end of each spring 76 nestles within its recess 75, while the upper end of each spring 76 engages within a vertical recess 77 formed in a transversely extending spring clamping plate 78. The two upper spring recesses 77, of which only one is shown in FIGS. 5 and 6, are aligned axially with the lower spring recesses 75 formed in the support plate 60. The spring clamping plate 78 spans the transverse gap between the spaced vertical uprights 70 of any U-shaped feed stand 71 and is secured to the uprights by any suitable means such as bolts (not shown).

When spring clamping plate 78 is properly mounted, the two springs 76 are compressed to exert a yieldable force on the assembly comprising upper sliver feed roll 44, sliver feed plate 47', support plates 57, 60 and clamping bolt 62. In practice, the springs 76 may be designed so that, under the influence of clamping plate 78, they exert a spring load of approximately 25 pounds on the assembly of which the feed roll 44 and the sliver feed plate 47' constitute parts. The arrangement permits the sliver passage 49' to widen or open, against the force of the springs 76, to provide increased clearance at the nip 54 and at the fiber pinch point 50 when there is an increase in the fiber volume passing through the passage 49'. The nip 54 and the pinch point 50 thus constitute spring loaded control points for the novel sliver feeding system of this invention. They are operative to maintain constant the torque required to drive the new feed system at a constant rate of fiber feed.

It is preferred, in the practice of the invention, to set a limit on the extent to which the fiber passage 40' may be enlarged—with consequent increase in the clearances at the nip 54 and the pinch point 50—to accommodate an increased flow of fibers between the feed rolls 20, 44 and through the passage 49' to the main cylinder 21. In practice, it has been found that the increased clearance at the nip 54 and the pinch point 50 preferably should not exceed a maximum of 2.0 mm, otherwise too great a volume of sliver fibers may be introduced into the feeding system, causing an overload with such consequent problems as impairing the quality of the fabric being knit, causing the breaking of needle heads and, possibly, creating an excessive build up of fibers on the main cylinder or doffer.

To limit the clearance at the nip 54 and pinch point 50 to a maximum on the order of 2.0 mm, suitable machine stop motion means (not shown) may be provided to shut down the knitting machine, and halt feeding of the sliver 14, when the clearances at nip 54 and pinch point 50 exceed 2.0 mm. The stop motion arrangement may be associated, with suitable insulated electric contacts or other sensor means, with either the upper sliver feed roll 44, or the sliver feed plate 47', or either of the support plates 57, 60, all of which move in unison against the force of the springs 76 under the influence of an increased volume of fibers passing through the fiber passage 49'. Such stop motion mechanisms, of course, are well known in this art. They are illustrated, for example, in my pending patent application Ser. No. 361,590, filed Mar. 25, 1982, entitled "Sliver Fault Detector for High Pile Fabric Knitting Machines", and in various patents such as U.S. Pat. Nos. 2,694,907, 3,122,904 and 4,270,369.

In the claims hereto, the term "relatively short fibers" shall indicate sliver fibers less than one inch in length.

Although several preferred embodiments of this invention have been shown and described herein for the purpose of illustration, as required by Title 35 U.S.C. §112, it is to be understood that various changes, modifications and alterations may be made thereto without departing from the spirit and utility of this invention, or the scope thereof as set forth in the claims. For example, this invention contemplates use of a carding head 10 in which the main cylinder 21 is eliminated, and the sliver feed components feed the sliver staple 14' directly to the wire-covered doffer 34. Additionally, where a sliver feed plate is utilized, as in the embodiments of FIGS. 4 and 6, larger sliver feed rolls may be employed, i.e. the rolls may have a circumference larger than four times the minimum length of the sliver fibers.

I claim:

1. In a feeding system for feeding relatively short fibers to a sliver high pile fabric knitting machine, said feeding system including a pair of rotatable feed rolls, a feed plate disposed in close proximity to the peripheries of the feed rolls and a rotatable doffer for delivering fibers to the needles of the knitting machine, the improvement comprising (a) a wire-covered feed roll rotatable about the fixed axis, (b) a smooth peripheried feed roll located operatively relative to the wire-covered feed roll to provide a nip, (c) a gap interposed between the periphery of the wire-covered feed roll and the feed plate to provide a passage for the fibers, said gap commencing at the nip and terminating in a fiber pinch point, whereby the nip provides a fiber entrance to the gap and the pinch point provides a fiber exit from the gap, (d) assembly means joining together the smooth peripheried feed roll and the feed plate to provide a unitary assembly with capacity for movement as a unit relative to the wire-covered feed roll and (e) resilient means urging the unitary assembly which includes the smooth peripheried feed roll and the feed plate yieldingly toward the wire-covered feed roll, (f) said resilient means being operative to permit the smooth peripheried feed roll and the feed plate to be retracted away from the wire-covered feed roll to enlarge clearance at the nip and at the fiber pinch point to accommodate an increase in the volume of fibers fed by the fiber feeding system to the knitting machine.

2. The fiber feeding system of claim 1, further including a feed plate edge portion disposed in close proximity with the surface of the smooth peripheried feed roll to prevent the wrapping of fibers about the surface of said roll.

3. The fiber feeding system of claim 2, further including adjustment means to locate selectively the feed plate edge portion relative to the surface of the smooth peripheried feed roll.

4. In a feeding system for feeding relatively short fibers to a sliver high pile fabric knitting machine, said fiber feeding system including a carding head having a pair of rotatable feed rolls, a feed plate disposed in close proximity to the peripheries of the feed rolls and a rotatable doffer for delivering fibers to the needles of the knitting machine, the improvement comprising (a) a smooth peripheried feed roll and a wire-covered feed roll, said feed rolls being disposed relative to each other to provide a nip, (b) a gap interconnected between the periphery of the wire-covered feed roll and the feed plate to provide a passage for the fibers, (c) said gap progressively narrowing in thickness and terminating in a fiber pinch point, and (d) a feed plate edge portion disposed in contact with the surface of the smooth peripheried feed roll to prevent the wrapping of fibers about the surface of said roll.

5. The fiber feeding system of claim 4, wherein (a) the wire-covered feed roll is rotatable about a fixed axis, (b) the smooth peripheried feed roll and the feed plate are assembled together to provide a unitary assembly with capacity for movement as a unit relative to the wire-covered feed roll and (c) resilient means urges the unitary assembly which includes the smooth peripheried feed roll and the feed plate yieldingly toward the wire-covered feed roll, (d) said resilient means being operative to permit the smooth peripheried feed roll and the feed plate to be retracted away from the wire-covered feed roll to enlarge fiber clearance at the nip and at the fiber pinch point to accommodate an increase in the volume of fibers fed by the fiber feeding system to the knitting machine.

6. The fiber feeding system of claim 4, further including resilient means yieldingly urging the feed plate and one feed roll of the pair of feed rolls into operative working association with the other feed roll of the pair of feed rolls.

7. The fiber feeding system of claim 4 in which the carding head includes a rotatable wire-covered main cylinder interposed between the feed rolls and the doffer, wherein (a) the nip provides a fiber entrance for the fiber passage provided by the gap, (b) the pinch point provides a fiber exit for the fiber passage provided by the gap and (c) the pinch point is disposed in close proximity to the wire-covered periphery of the main cylinder.

8. The fiber feeding system of claim 7, wherein (a) the wire-covered feed roll is rotatable about a fixed axis, (b) the smooth peripheried feed roll and the feed plate are assembled together to provide a unitary assembly with capacity for movement as a unit relative to the wire-covered feed roll and (c) resilient means urges the unitary assembly which includes the smooth peripheried feed roll and the feed plate yieldingly toward the wire-covered feed roll, (d) said resilient means being operative to permit the smooth peripheried feed roll and the feed plate to be retracted away from the wire-covered feed roll to enlarge the clearances at the nip and at the fiber pinch point to accommodate an increase in the volume of fibers fed by the fiber feeding system to the knitting machine.

9. The fiber feeding system of claim 4 in which the carding head includes a rotatable main cylinder interposed between the feed rolls and the doffer, wherein (a) the main cylinder is provided with card clothing constituting a smooth-peripheried backing layer having a plurality of individual wires extending outwardly therefrom, (b) said main cylinder wires having (i) shank portions embedded in the backing layer, (ii) distal portions extending linearly outward of the peripheral surface of the backing layer at an acute angle relative to said peripheral surface and (iii) knee portions connecting the shank portions to the distal portions, said knee portions having an angle greater than 90°.

10. The fiber feeding system of claim 9, wherein (a) the doffer is provided with card clothing constituting a smooth-peripheried backing layer having a plurality of individual wires extending outwardly therefrom, (b) said doffer wires having (i) shank portions embedded in the backing layer in cantilever fashion, (ii) distal portions spaced outwardly from the peripheral surface of the backing layer and (iii) knee portions connecting the shank portions to the distal portions, said knee portions having an angle greater than 130°.

11. The fiber feeding system of claim 7, wherein the distal portions of the wires extend linearly outward of the main cylinder at an angle on the order of 60° relative to the peripheral surface of the backing layer.

* * * * *

UNITED STATES PATENT AND TRADEMARK OFFICE

CERTIFICATE OF CORRECTION

PATENT NO. : 4,408,370

DATED : October 11, 1983

INVENTOR(S) : Earl R. Quay

It is certified that error appears in the above-identified patent and that said Letters Patent are hereby corrected as shown below:

Column 9, line 55 change "interconnected" to --interposed--

Signed and Sealed this

*Third* Day of *January 1984*

[SEAL]

*Attest:*

GERALD J. MOSSINGHOFF

*Attesting Officer*

*Commissioner of Patents and Trademarks*